US012110148B2

(12) United States Patent
Roelofs

(10) Patent No.: US 12,110,148 B2
(45) Date of Patent: Oct. 8, 2024

(54) STACKABLE CONTAINER HAVING HINGED WALLS

(71) Applicant: Euro Pool System International B.V., Rijswijk (NL)

(72) Inventor: Christian Roelofs, Ringe (DE)

(73) Assignee: Euro Pool System International B.V., Rijswijk (NL)

( * ) Notice: Subject to any disclaimer, the term of this patent is extended or adjusted under 35 U.S.C. 154(b) by 0 days.

(21) Appl. No.: 17/688,395

(22) Filed: Mar. 7, 2022

(65) Prior Publication Data

US 2022/0297883 A1 Sep. 22, 2022

(30) Foreign Application Priority Data

Mar. 17, 2021 (EP) ..... 21163179

(51) Int. Cl.
*B65D 6/18* (2006.01)
*B65D 21/02* (2006.01)

(52) U.S. Cl.
CPC ..... *B65D 11/1833* (2013.01); *B65D 21/0213* (2013.01)

(58) Field of Classification Search
CPC ..... B65D 25/005
USPC ..... 220/51, 516, 666
See application file for complete search history.

(56) References Cited

U.S. PATENT DOCUMENTS 3,762,594 A * 10/1973 Utz ..... B65D 25/005 206/427
3,841,519 A * 10/1974 Stromberg ..... B65D 1/243 206/427
9,475,638 B2 10/2016 Cavalcante et al.
10,351,295 B2 7/2019 Van Der Korput
2009/0134157 A1* 5/2009 Meers ..... B65D 11/184 220/6
2011/0139674 A1* 6/2011 Van der Korput ..... B65D 19/08 206/598

(Continued)

FOREIGN PATENT DOCUMENTS

DE 4310812 A1 10/1994
EP 2078679 A1 7/2009

(Continued)

OTHER PUBLICATIONS

European Search Report; priority document.

*Primary Examiner* — Ernesto A Grano
*Assistant Examiner* — Symren K Sanghera
(74) *Attorney, Agent, or Firm* — Greer, Burns & Crain, Ltd.

(57) ABSTRACT

A stackable container including a rectangular base and four side walls hinged to the base. The side walls pivot between an erected useful position and an empty position folded in towards the base. At least one of the walls has a selectively covered or uncovered recess spaced from two lateral edges and a lower edge of this wall. A wall rail arranged parallel to the base is vertically displaceably guided in sliding guides between an upper covering and a lower uncovering position. Between the wall rail and the lower edge of the recess are at least two wall braces that, in the covering position, run obliquely and are spaced apart from one another in a longitudinal direction of the wall and are each connected at their ends in a hinged manner to the wall rail and, at the lower edge of the recess, to the wall having the recess.

19 Claims, 7 Drawing Sheets

(56) References Cited

U.S. PATENT DOCUMENTS

| | | | | |
|---|---|---|---|---|
| 2012/0037647 | A1* | 2/2012 | Cook | B65D 11/1833 220/666 |
| 2012/0111859 | A1* | 5/2012 | Pils | B65D 11/1833 220/4.28 |
| 2013/0075679 | A1* | 3/2013 | McIntosh | B66F 7/0608 254/102 |
| 2014/0251992 | A1* | 9/2014 | Cavalcante | B65D 11/184 220/4.28 |
| 2016/0039598 | A1* | 2/2016 | Wilcox | B65D 25/005 206/423 |
| 2018/0228300 | A1* | 8/2018 | Mendes | A47D 13/043 |
| 2019/0031392 | A1* | 1/2019 | Roelofs | B65D 11/28 |
| 2019/0038018 | A1* | 2/2019 | Hill | F16B 2/12 |
| 2020/0247583 | A1* | 8/2020 | Sekowski | B65D 21/0209 |
| 2022/0097905 | A1* | 3/2022 | Apps | B65D 11/184 |

FOREIGN PATENT DOCUMENTS

| | | | |
|---|---|---|---|
| WO | 2011144220 | A1 | 11/2011 |
| WO | 2016169827 | A1 | 10/2016 |

* cited by examiner

STACKABLE CONTAINER HAVING HINGED WALLS

CROSS-REFERENCES TO RELATED APPLICATIONS

This application claims the benefit of the European patent application No. 21163179.1 filed on Mar. 17, 2021, the entire disclosures of which are incorporated herein by way of reference.

FIELD OF THE INVENTION

The present invention relates to a stackable container with a rectangular base, with two longer walls hingedly connected to the base and two shorter walls hingedly connected to the base, the walls being pivotable between an erected useful position and an empty position folded in towards the base, at least one of the walls having a recess that keeps a distance between two lateral edges and a lower edge of this wall, which recess can be covered for a transport of transport items accommodated in the container and can be uncovered for a presentation and removal of the transport items.

BACKGROUND OF THE INVENTION

A container of the type mentioned above is known from the document DE 43 10 812 A1. This document describes a stackable container with walls that can be folded onto the bottom of the container and a lid for transporting and picking goods, in which a closable opening is provided in at least one of its side walls to allow access to the interior of the container. A roller blind can be provided with which the opening can be closed; the roller blind can be horizontally or vertically displaceable. In the case of a vertically displaceable roller blind, this blind lies in a double bottom of the container in its open position. This requires a relatively high base, which disadvantageously results in a relatively large height of the container when the walls are folded in. It is also disadvantageous here that the lid is a loose individual part of the container, which causes an increased risk of losing the lid in practical use.

WO 2016/169827 A1 indicates a container, in particular a display container, for the transport and storage or presentation of goods, having a rectangular base, a first side wall section hingedly connected to the base, which can be folded about a horizontal folding axis or an axis parallel to the base between a first folding position folded outwards away from the base and oriented vertically and a second folding position folded inwards towards the base and oriented horizontally, and at least one second side wall section hingedly connected to a side edge of the first side wall section and pivotable about a pivot axis that is vertical or perpendicular to the base between a first pivot position pivoted laterally away from the first side wall section at right angles and a second pivot position pivoted toward the first side wall section. It is essential that the first side wall section and/or the second side wall section has at least one angled, right-angled or L-shaped side edge section at the side edges facing one another, and the two side wall sections are hinged to one another in such a way that the at least one angled side edge section of at least one of the two side wall sections bears flatly against the other side wall section at least in the first pivoted position. On the other, opposite side wall section, the second side wall section can have a vertical groove which is open inwardly, in particular also upward, for receiving a side wall insert, for example in the form of a vertically displaceable side wall element, folding grille or wall replacement. Latching means may be provided on the groove itself or in the area of the groove for releasably arresting the side wall insert in one or more predetermined positions. On the side opposite the first side wall section, the base can have a base edge section with a receptacle for a side wall insert, e.g., in the form of a vertically displaceable side wall element, folding grille or wall replacement. It is considered a disadvantage here that the side wall insert is a loose individual part of the container that can easily be lost and damaged in practical use. In addition, this makes handling of the container awkward for its user. Alternatively, the vertically displaceable side wall element can be integrated into the container base and, when the walls are in the use position, can be pulled upwards from this base along guides provided in the vertical edges of the adjacent walls, and arrested in place. However, it is to be considered a disadvantage that for a folding of the walls of the container into the empty position, the side wall element must in any case be moved beforehand into its lowermost position recessed in the base, which makes its handling in practical use laborious and awkward for the users of the container.

In U.S. Pat. No. 9,475,638 B2, FIGS. 33 and 34 show a container with hinged walls, but in this container only three hinged walls are provided, namely two side walls and a rear wall. There is no front hinged wall here. Instead, an upper rail (720) is provided there, which is guided at its outer ends in vertical guides on the adjacent side edges of the two side walls so as to be displaceable in the vertical direction. Furthermore, two diagonal braces (braces 722) are provided which cross each other and are hinged together at the crossing point. The upper ends of the diagonal braces can be moved horizontally at a variable distance from each other and are mounted hingedly in the upper rail. The lower ends of the diagonal braces can each be moved horizontally at a variable distance from one another and are mounted in an articulated manner in the outward-facing edge of the container base. In order to be able to fold in the three hinged walls, the rail must be moved to its lowest position, in which it rests on the base, as shown in FIG. 34 of this document. This results in the folding axes of the three hinged walls having to run relatively high above the base, which disadvantageously results in a relatively large height of the container in its folded-together state.

SUMMARY OF THE INVENTION

The present invention therefore has an object of creating a container of the type mentioned above that can be used for transport and presentation purposes, and that avoids the disadvantages of the prior art described above and that, in particular, has no loose individual parts, and that is easy to handle for its users, and that has as low a remaining height as possible in its folded-together state, and can be produced at low cost.

According to the present invention, this object is achieved by a container of the type named above that is characterized in that a wall rail running horizontally parallel to the base is vertically displaceably guided, at its ends, in sliding guides running along the lateral edges of the recess on the wall having the recess, seen in the useful position of the walls, between an upper covering position and a lower uncovering position for the recess, and in that between the wall rail and the lower edge of the recess there are situated at least two wall braces that, in the covering position of the wall rail, run obliquely to the vertical and are spaced apart from one another in the longitudinal direction of the wall and that are connected at their ends in each case in a hinged manner to the wall rail and at the lower edge of the recess to the wall having the recess.

Advantageously, the present invention provides a container which is well suited and usable both for transporting transport items and for displaying transport items, which avoids a laborious manual repacking of items after transport from a transport container into a presentation or display container. In the useful position of the walls of the container, the wall rail is in its uppermost position for transport purposes, and the wall rail and the wall braces connected thereto cover the recess in the wall to such an extent that no transport items can fall out of the container during transport. For the presentation of the transport items in the container, the wall rail with the wall braces is moved to its lowest position near the bottom of the container, so that the recess in the relevant wall is then open and viewing as well as removal of transport items is possible even from containers stacked on top of each other.

In a first further embodiment of the container according to the present invention, it is provided that the wall braces are each additionally guided at their lower end at the lower edge of the recess, in guides on the wall having the recess, so as to be displaceable in the longitudinal direction of the lower edge of the recess, and that the wall braces each have a fixed pivot point at their upper end.

A further alternative embodiment of the container according to the present invention in this respect provides that the wall braces are each additionally guided at their upper end on the wall rail so as to be displaceable in the longitudinal direction of the wall rail, and that the wall braces each have a fixed pivot point at their lower end.

A further alternative embodiment of the container according to the present invention in this respect provides that the wall braces are made so as to be capable of telescoping, in each case having at least two brace sections which are displaceable relative to one another in the longitudinal direction thereof.

In all three aforementioned embodiments, the wall braces can follow a vertical displacement of the wall rail between its uppermost and lowermost positions without constraint.

Furthermore, the present invention proposes that two latches are situated on or in the wall rail, which are adjustable between a locking position, in which the wall rail is locked at its two ends at least in its covering position against the wall having the recess, and an unlocking position. With the latches, the wall rail can be fixed at least in its uppermost position forming the covering position, so that an undesired automatic displacement and thus opening of the recess is reliably prevented, in particular during transport of items to be transported in the container. If required, the latches and the adjacent wall areas of the wall or walls of the container having the recess and cooperating with the latches can also be set up to lock the wall rail in further positions, in particular in the lower uncovering position of the wall rail.

The latches can, for example, be sliding latches that are preloaded by a spring force in the locking direction and that can be manually displaced in the unlocking direction.

For the purpose of favorable manufacture of the container according to the present invention, it is further proposed that, with the latches situated on or in the wall rail, identical or similar latches are situated on the shorter walls or on the longer walls for releasable locking of the walls relative to one another in their erected useful position.

As an alternative to the above-mentioned latches on or in the wall rail, two locking elements can be situated on the wall rail or on the sliding guides of the wall having the recess, releasably locking the wall rail at its two ends at least in its covering position relative to the wall having the recess. In this embodiment, manual application of a downward force of sufficient magnitude to the wall rail is sufficient to release the wall rail from the locking in its cover position, without having to manually adjust latches or other elements. The locking elements can be, for example, locking balls or locking lugs that are resiliently preloaded in the locking direction and that cooperate, for example, in each case with at least one locking recess on the sliding guides that guide the wall rail, or at the ends of the wall rail.

The stackable container according to the present invention can be designed differently with respect to the situation of the recess or recesses and their number.

A first embodiment related thereto provides that one of the two longer walls or one of the two shorter walls has a recess with wall rail and wall braces. In this embodiment, the container requires only one particular wall with recess, wall rail and wall braces, while all three further walls can be standard walls that, as well as the container bottom in any case, can be taken over from already known folding containers.

A second embodiment relating thereto of the container provides that both longer walls or both shorter walls each have a recess with wall rail and wall braces. This embodiment offers in particular the advantage that the container can be viewed from two opposite sides and that transport items can be removed from the container from two opposite sides, provided that the container or a stack of containers is accessible from the two opposite sides. A second advantage here is that, when such containers are set down or stacked, it is not necessary to pay attention to a particular orientation of the, or each, container in which its side having the recess points in a required direction.

A third embodiment relating thereto of the container provides that one or both of the longer walls and one or both of the shorter walls each have a recess with wall rail and wall braces. This embodiment offers in particular the advantage that the container can be viewed from at least two adjacent sides and that transport items can be removed from the container from at least two adjacent sides, provided that the container or a stack of containers is accessible from the at least two adjacent sides.

A preferred field of application of the container according to the present invention is food logistics between food producers and food retailers, where the container can be used in a variety of ways, for example for the transport and presentation of fruit, vegetables, baked goods, egg packages, and the like.

Advantageously, there is the possibility of optionally exposing or concealing the recess for each such container situated in a stack of containers, because the displacement of the wall rail can take place regardless of whether the container is standing alone or is situated in a stack of containers.

It is also advantageous for the handling of the container according to the present invention by its user that it does not matter in which position the wall rail and the wall braces are currently located when folding an empty container. Folding of the wall with the recess with the wall rail and wall braces is possible without hindrance completely independently of the current position of the wall rail, because the wall rail and the wall braces extend and move only within the wall with the recess and do not touch any areas of the adjacent walls and/or the bottom of the container.

As mentioned above, significant parts of the container according to the present invention can be adopted from existing hinged containers, which keeps the manufacture of the container according to the present invention favorable for the manufacturer.

There is also the advantageous possibility of converting stackable hinged containers already in use to containers according to the present invention by simply exchanging at least one of the conventional walls of the container for a wall having a recess, wall rail and wall braces. Such an exchange is usually possible without damage, because the hinged walls of containers already known and used on the market are hinged to the base by hinges that can be engaged and disengaged without destruction, so that individual damaged walls can be replaced if necessary.

Relevant stackable and collapsible containers used in food logistics usually have a base area of 600 mm×400 mm, with the longer walls of the container correspondingly having a horizontal length of 600 mm. The height of the containers varies, depending on the intended use and the goods to be transported. The recess in at least one of the walls should preferably have an area as large as possible, but still ensuring sufficient wall stability.

BRIEF DESCRIPTION OF THE DRAWINGS

In the following, an exemplary embodiment of the present invention is explained with reference to a drawing. In the Figures of the drawing.

In the following description of the Figures, the same parts in the various Figures are always given the same reference characters, so that it is not necessary to explain all the reference characters again for each Figure.

DETAILED DESCRIPTION OF THE PREFERRED EMBODIMENTS

Figure 1:
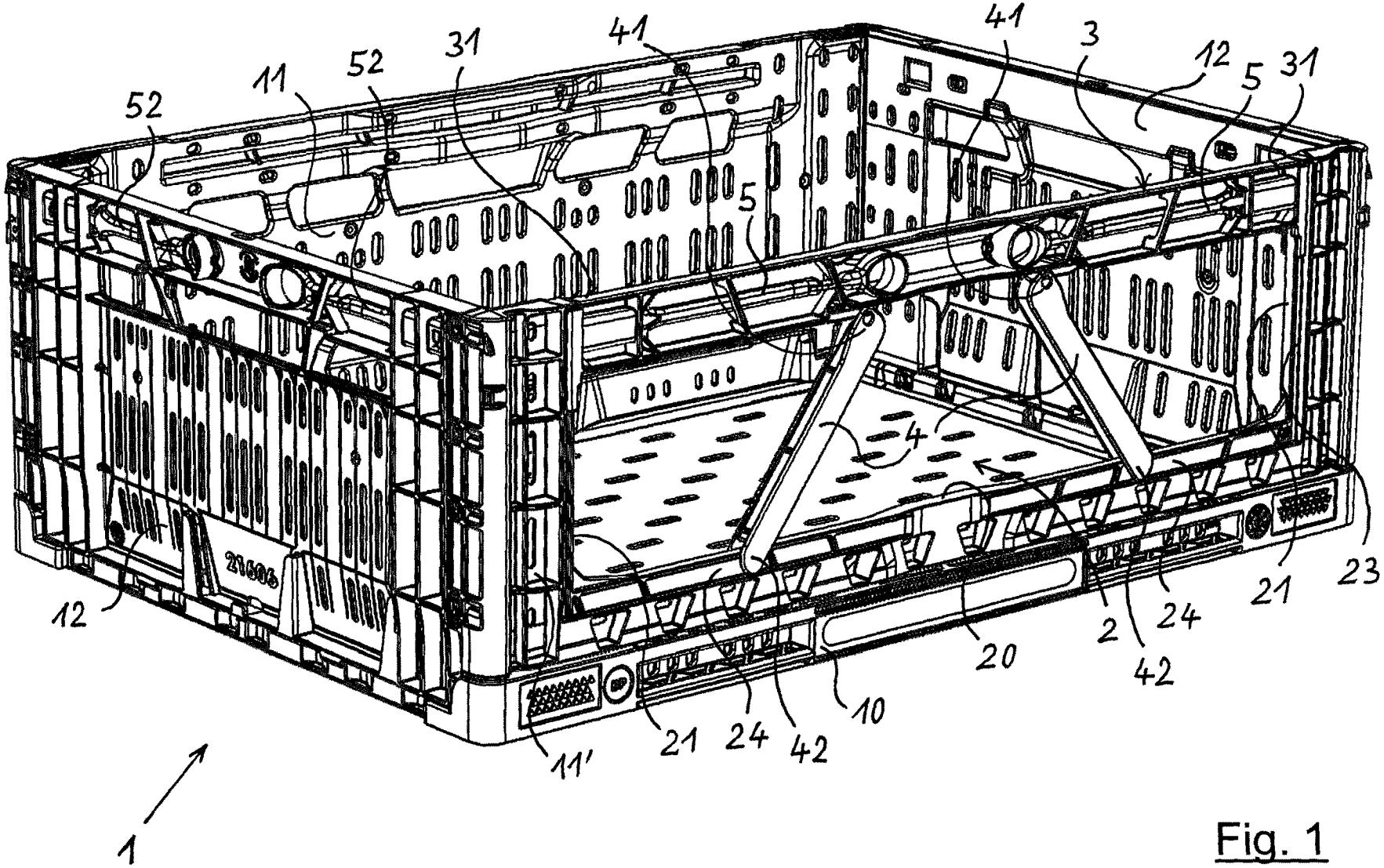
FIG. 1 shows a stackable empty container with four foldable walls in the erected useful position, one of which walls is formed with a recess concealed here by a wall rail and wall braces, in an oblique view from above.

FIG. 1 of the drawing shows a stackable, empty container 1 with a rectangular base 10 and four walls 11, 11', 12 pivotably connected thereto and foldable towards the base 10, in an erected useful position, in a view obliquely from above. Here, the walls 11, 11' are longer walls and the walls 12 are shorter walls. The longer wall 11' facing the viewer in FIG. 1 is formed with a rectangular recess 2 that is open at the top and that is spaced laterally from two lateral edges and at the bottom from a lower edge of this wall 11'.

The recess 2 can be covered for a transport of transport items accommodated in the container 1 and not shown in FIG. 1 and can be uncovered for a presentation and removal of the transport items.

For this purpose, a wall rail 3 running horizontally parallel to the base 10 is situated in the recess 2, which wall rail 3 is guided at its ends 31 in sliding guides 23 running along lateral edges 21 of recess 2 on the front longer wall 11' having the recess 2, seen in the useful position of the walls 11, 11', 12, so as to be vertically displaceable between an upper covering position and a lower uncovering position for the recess 2.

Furthermore, between wall rail 3 and lower edge 20 of recess 2, two wall braces 4 are situated which run obliquely to the vertical in the upper covering position of wall rail 3 and are spaced apart from one another in the longitudinal direction of wall 11'. At their ends 41, 42, wall braces 4 are each hingedly connected to wall rail 3 and, at lower edge 20 of recess 2, to wall 11' having recess 2. Moreover, wall braces 4 are each additionally guided at their lower end 42 on lower edge 20 of recess 2 in guides 24 on wall 11' having recess 2 so as to be displaceable in the longitudinal direction of lower edge 20 of recess 2. At their upper end 42, wall braces 4 each have a fixed pivot point on wall rail 3.

Two latches 5 displaceable in the longitudinal direction of wall rail 3 are situated on wall rail 3, each of which is adjustable between a locking position locking wall rail 3 at its two ends 31 to wall 11' having recess 2, at least in its covering position shown in FIG. 1, and an unlocking position. In the embodiment shown, latches 5 are sliding latches in the form of one-piece injection-molded plastic parts that are preloaded by a spring force in the locking direction and are manually displaceable in the unlocking direction and are situated and guided on the outward-facing side of wall rail 3.

As an alternative to the above-mentioned latches 5 on or in wall rail 3, two locking elements that releasably lock wall rail 3 at its two ends 31 at least in its covering position to wall 11' having recess 2 can be situated on wall rail 3 or on sliding guides 23 of wall 11' having recess 2, for example locking balls or locking lugs that are preloaded by a spring force in the locking direction and that, for example, each cooperate with at least one locking recess on sliding guides 23 guiding wall rail 3 or on ends 31 of wall rail 3.

On shorter walls 12 of container 1 according to FIG. 1, identical or similar latches 52, for releasably locking walls 11, 11', 12 to one another in their erected useful position, are situated directly below the upper edge of shorter walls 12 having latches 5 situated on wall rail 3.

Figure 2:
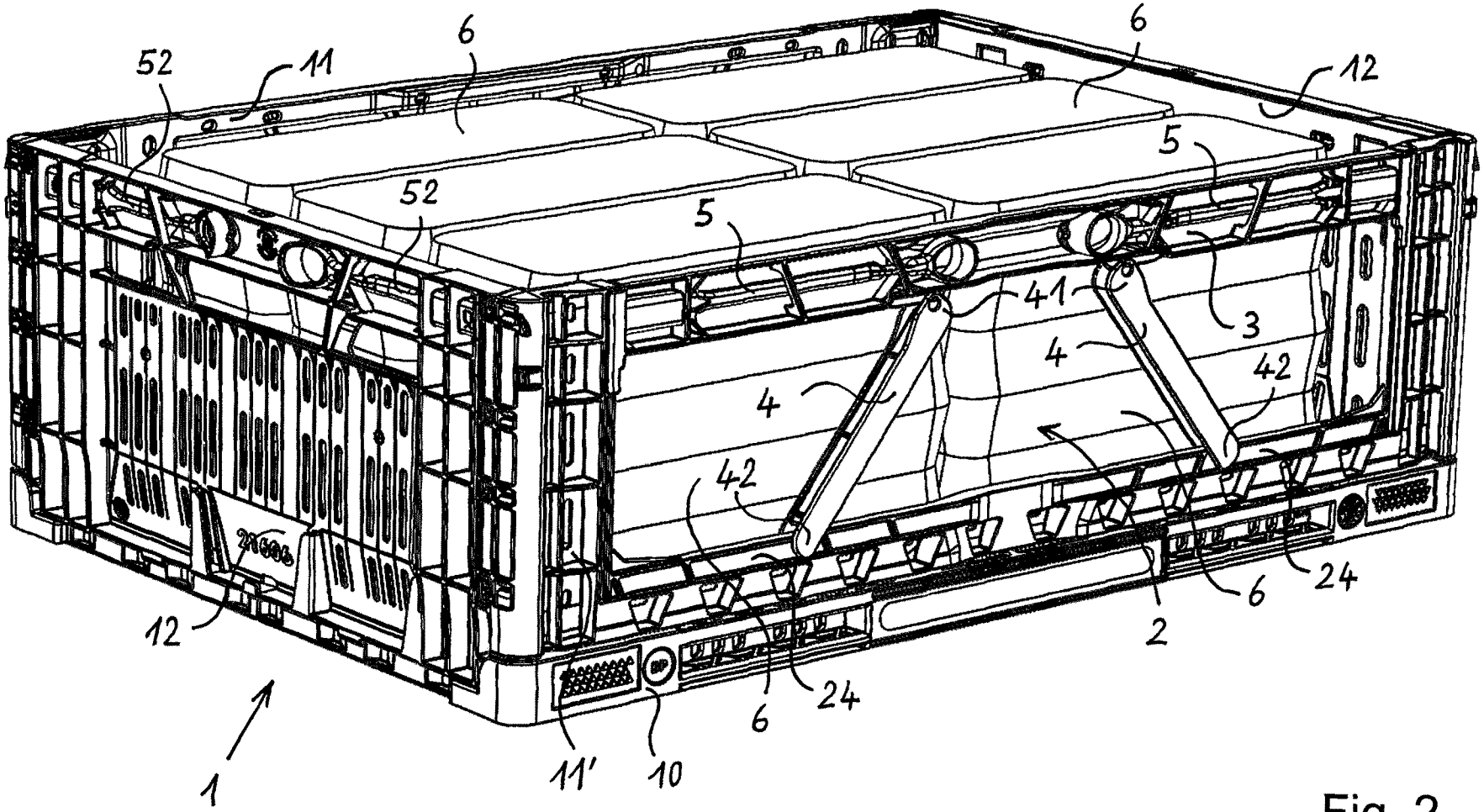
FIG. 2 shows the container of FIG. 1 with the walls in the erected useful position and concealed recess, with transport items situated in the container, also in an oblique view from above.

FIG. 2 shows container 1 of FIG. 1 with walls 11, 11', 12 in the erected useful position and with the recess concealed by wall rail 3 and wall braces 4, now with transport items 6 situated in container 1, also in an oblique view from above. In the example shown here, transport items 6 are egg cartons; however, other transport items can, of course, also be accommodated in container 1.

As FIG. 2 illustrates, wall rail 3 located in its upper covering position in recess 2, together with wall braces 4 connected thereto, ensures that no transport items 6 can fall out of container 1 unintentionally, in particular during transport and the vibrations frequently associated therewith.

In the case of smaller transport items 6, more than two wall braces 4 can also be provided.

FIG. 2 also shows that containers 1 filled with items 6 can be stacked one on top of the other, such that, as is known per se, an upper container 1 stands with its base 10 on the upper edge of the walls 11, 11', 12 of a lower container 1 and engages in the latter for the purpose of securing against displacement.

Figure 3:
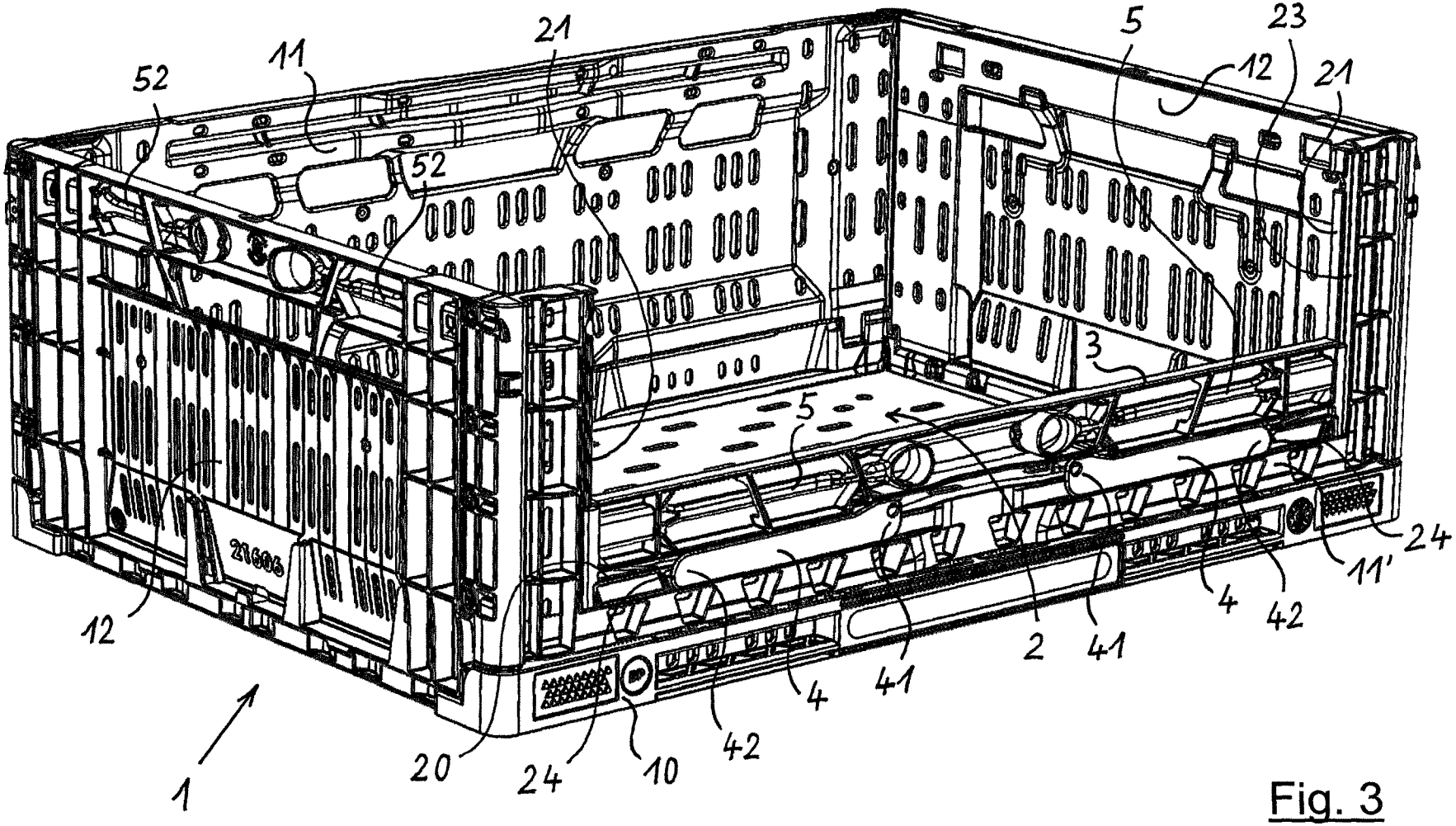
FIG. 3 shows the container of FIG. 1 with the walls in the erected, useful position and with the recess here uncovered, also in an oblique view from above.

FIG. 3 shows container 1 of FIG. 1 with walls 11, 11', 12 in the upright position and with recess 2 here uncovered, also in an oblique view from above. To uncover recess 2, wall rail 3 is moved downwards along sliding guides 23 on lateral edges 21 of recess 2 in the direction of base 10 after latches 5 have been released.

When wall rail 3 is lowered, wall braces 4, each hinged to wall rail 3 at a fixed pivot point at their upper end 41, move sideways outward along guides 24 on lower edge 20 of recess 2, each with their lower end 42, until wall rail 3 and wall braces 4 have reached the lowest position shown in FIG. 3. In this uncovering position of wall rail 3 and wall braces 4, it is possible to view transport items in container 1 and to remove transport items from container 1, e.g., for customers in a supermarket, without any problems. At the same time, access to the interior of container 1 remains unobstructed even when containers 1 are stacked one on top of the other.

Since wall rail 3 and wall braces 4 move only in the area of wall 11' having recess 2, the adjustment of wall rail 3 and wall braces 4 between the covering position and the uncovering position for recess 2 can be carried out without obstruction even when containers 1 are configured in a stack.

Figure 4:
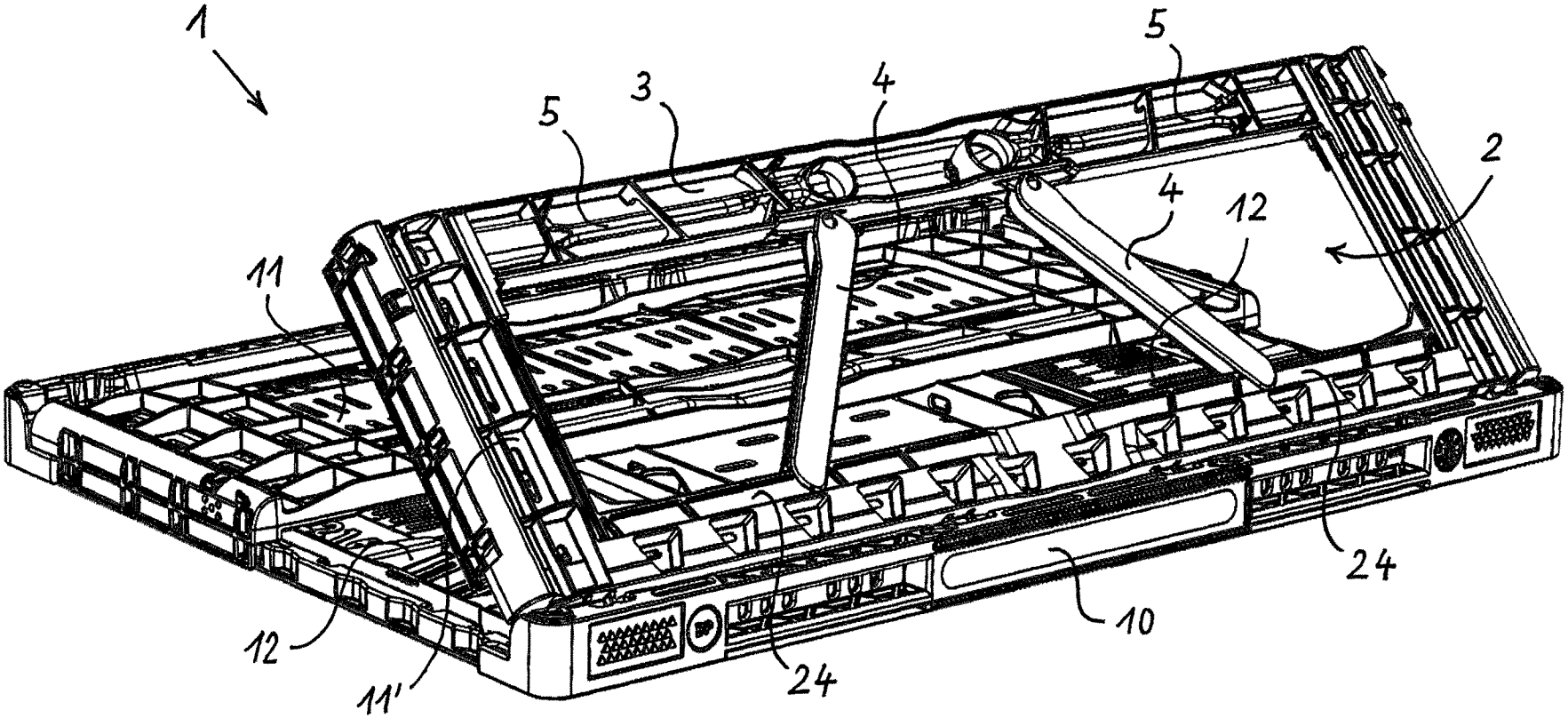
FIG. 4 shows the container of FIG. 1 with three walls already folded in towards the base and with a fourth wall, having the recess, during its folding, also in an oblique view from above.

FIG. 4 shows the container 1 of FIG. 1, with three walls 11, 12 already folded in towards base 10 and with the fourth front longer wall 11' having the recess 2 during its folding, also in an oblique view from above.

For the folding in of walls 11, 11', 12, latches 52 situated externally on the respective left-hand shorter side wall 12 in FIGS. 1 to 3 and latches 52 situated mirror-symmetrically on the respective oppositely situated right-hand shorter side wall 12 and concealed there are adjusted in the release direction, in this case in the inward direction towards one another. This releases the mutual locking of walls 11, 11', 12 and it is then possible to fold in first the shorter walls 12 and then the longer walls 11, 11' towards base 10.

Figure 5:
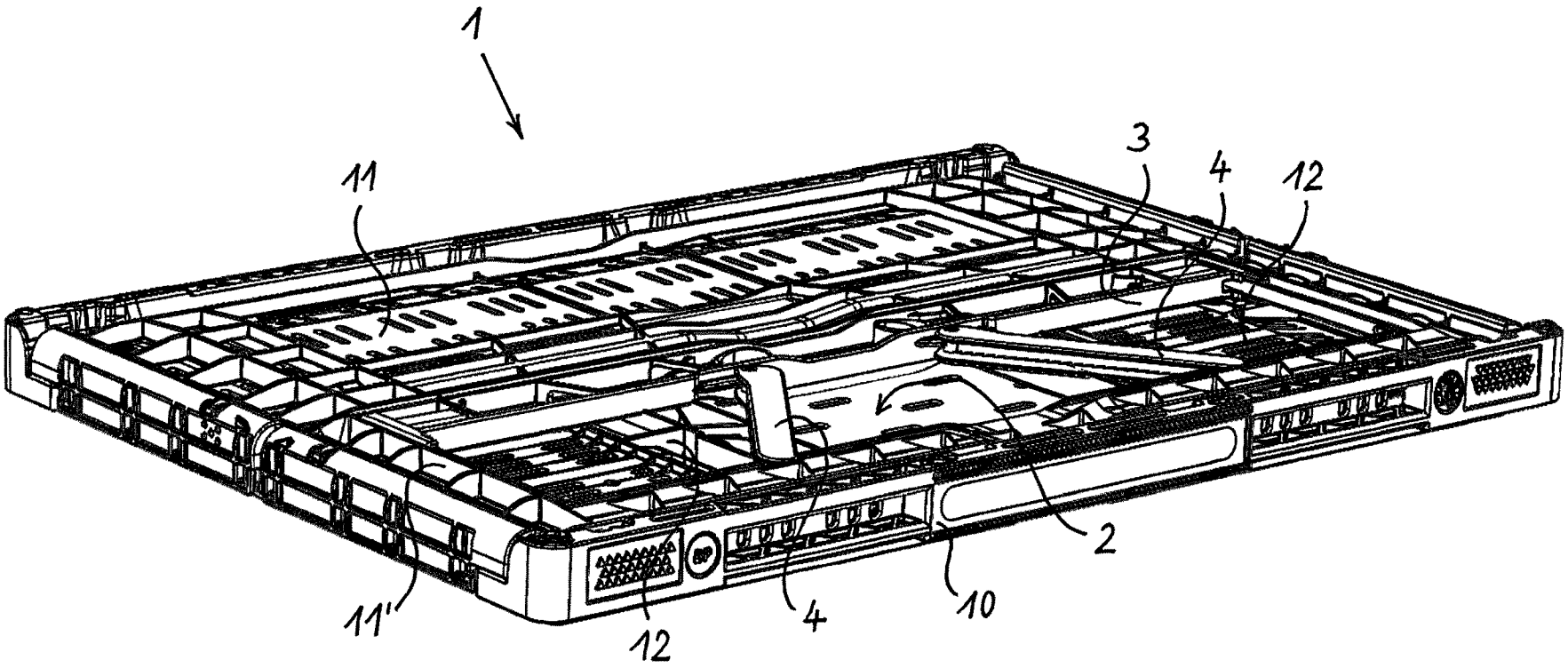
FIG. 5 shows the container of FIG. 1 with all four walls in the folded-in empty position and with the recess here concealed, also in an oblique view from above.

This results in a particularly low height of container 1 in its empty, collapsed state, as shown in FIG. 5 using the example of a completely collapsed container 1, which enables space-saving transport of empty containers 1.

Figure 6:
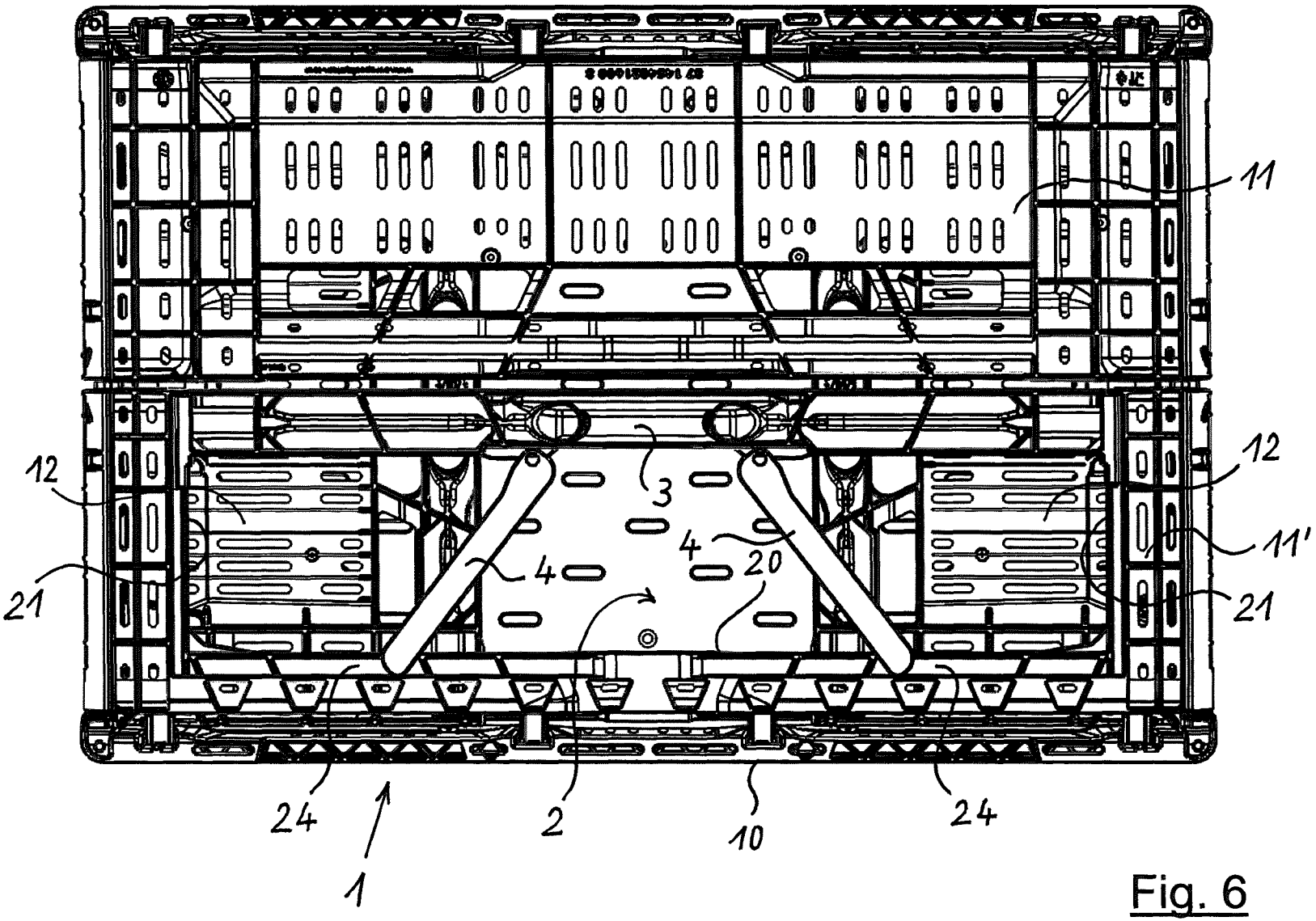
FIG. 6 shows the container of FIG. 5 with all four walls in the folded-in empty position and with recess here covered, in a top view.

FIG. 6 shows container 1 of FIG. 5 with all four walls 11, 11', 12 in the folded-in empty position and with recess 2 here concealed, in a plan view. Wall rail 3 runs here along the upper edge of recess 2 in wall 11' and wall braces 4 run from wall rail 3 obliquely downward and outward to lower edge 20 of recess 2.

Figure 7:
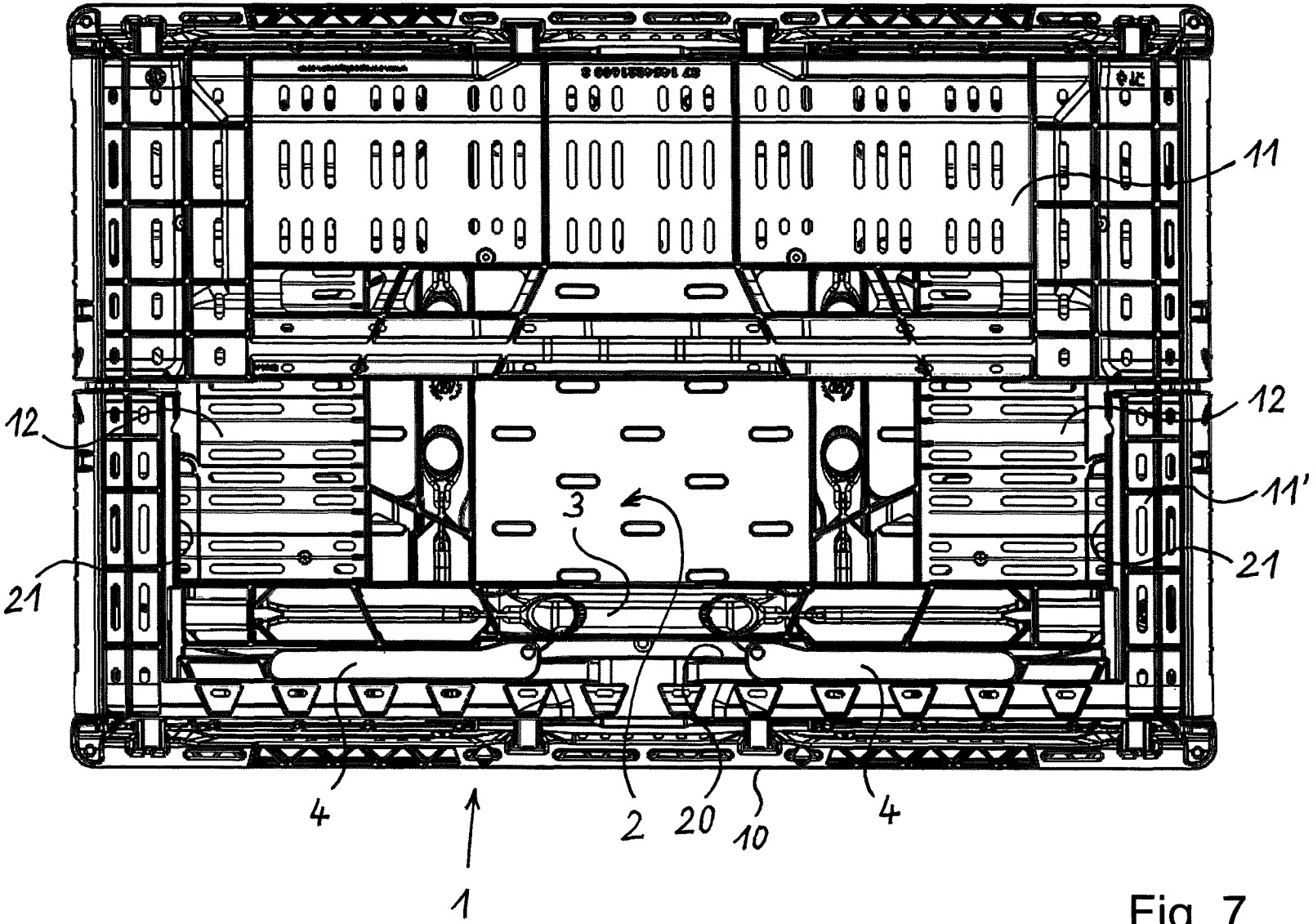
FIG. 7 shows the container of FIG. 1 with all four walls in the folded-in empty position and with recess here uncovered, in a plan view.

Finally, FIG. 7 shows container 1 of FIG. 1 with all four walls 11, 11', 12 in the folded-in empty position and with recess 2 here uncovered, also in a plan view. Wall rail 3 here runs along lower edge 20 of recess 2 in wall 11' and wall braces 4 now run horizontally directly below wall rail 3

FIGS. 6 and 7 illustrate that for the folding of the container 1 it does not matter in which position wall rail 3 and wall braces 4 are currently situated, which simplifies the handling of container 1, in particular when it is folded.

The parts of container 1, i.e., its base 10, its walls 11, 11', 12, wall rail 3, wall braces 4, and latches 5, 52 are usefully made of injection-molded plastic parts for the purpose of cost-effective mass production, low weight, and good durability of the container 1.

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

LIST OF REFERENCE CHARACTERS

1 stackable container
10 base
11 longer wall without recess
11' longer wall with recess
12 shorter walls
2 recess in 11'
20 lower edge of 2
21 lateral edges of 2
23 sliding guides on 21 for 3
24 guides for 4 on 20
3 wall rail
31 ends of 3
4 wall braces
41 upper end of 4
42 lower end of 4
5 latch on 3
52 latch on 12
6 transport items

The invention claimed is:

1. A stackable container comprising:

a rectangular base, two longer walls connected in hinged fashion to the base, and two shorter walls connected in hinged fashion to the base, the longer and shorter walls being pivotable between an erected useful position and an empty position folded in towards the base, at least one of the walls having a recess defined by two lateral edges which are spaced apart and a lower edge of said respective wall, the recess being configured to be covered for a transport of transport items housed in the container and configured to be uncovered for a presentation and removal of the transport items, wherein a wall rail that runs horizontally parallel to the base is guided in a vertically displaceable fashion at its ends in sliding guides that run along the lateral edges of the recess, between a raised position where the recess is covered and a lowered position where the recess is uncovered, and wherein between the wall rail and the lower edge of the recess there are situated at least two wall braces that, in the raised position of the wall rail, run obliquely to the vertical direction away from one another and are spaced apart from one another in a longitudinal direction of the wall, wherein each of the at least two braces includes an upper end and a lower end, such that the upper end of each brace is connected in a hinged manner to the wall rail.

2. The stackable container according to claim 1, wherein the lower end of the wall braces are each additionally displaceably guided in the longitudinal direction on guides in the lower edge of the recess, and wherein the wall braces each have a fixed pivot point at the upper end.

3. The stackable container according to claim 1, wherein each wall brace is additionally guided at the upper end in the longitudinal direction of the wall rail in displaceable fashion on the wall rail.

4. The stackable container according to claim 1, wherein the wall braces are configured to be capable of telescoping, having in each case at least two brace sections that are displaceable relative to one another in a longitudinal direction thereof.

5. The stackable container as recited in claim 1, wherein two wall rail latches are situated on or in the wall rail that are displaceable between a locking position that locks the wall rail at its two ends, at least in their the raised position, to the at least one of the longer and shorter walls having the recess, and an unlocking position.

6. The stackable container according to claim 5, wherein wall latches are situated on the shorter walls or on the longer walls for a releasable locking of the two longer walls and the two shorter walls to one another in the erected useful position.

7. The stackable container according to claim 5, wherein wall latches identical to the wall rail latches situated on or in the wall rail, are situated on the shorter walls or on the longer walls for a releasable locking of the walls to one another in the erected useful position.

8. The stackable container according to claim 1, wherein two locking elements that releasably lock the wall rail at its two ends at least in its covering position to the wall having the recess are situated on the wall rail of the wall having the recess.

9. The stackable container according to claim 1, wherein two (Original) locking elements that releasably lock the wall rail at its two ends at least in its covering position to the wall having the recess are situated on the sliding guides of the wall having the recess.

10. The stackable container according to claim 1, wherein one of the two longer walls has the recess having the wall rail and wall braces.

11. The stackable container according to claim 1, wherein one of the two shorter walls has the recess having the wall rail and wall braces.

12. The stackable container according to claim 1, wherein the two longer walls each have the recess having the wall rail and wall braces.

13. The stackable container according to claim 1, wherein the two shorter walls each have the recess having the wall rail and wall braces.

14. The stackable container according to claim 1, wherein both longer walls and both shorter walls each have the recess having the wall rail and wall braces.

15. A stackable container comprising:

a rectangular base, four side walls connected in hinged fashion to the base, the side walls being pivotable between an erected useful position and an empty position folded in towards the base, at least one of the side walls having a recess defined by two lateral edges which are spaced apart and a lower edge of the at least one of the side walls, the recess being configured to be covered for a transport of transport items housed in the container and configured to be uncovered for a presentation and removal of the transport items, wherein a wall rail that runs horizontally parallel to the base is guided in a vertically displaceable fashion at its ends in sliding guides that run at the lateral edges of the recess on the at least one of the side walls having the recess, between a raised position where the recess is covered and lowered position where the recess is uncovered, and wherein between the wall rail and the lower edge of the recess there are situated at least two wall braces that, in the raised position of the wall rail, run obliquely to the vertical direction away from one another and are spaced apart from one another in a longitudinal direction of the wall, wherein each of the at least two braces includes an upper end and a lower end, such that the upper end of each brace is connected in a hinged manner to the wall rail.

16. The stackable container according to claim 15, wherein the lower end of the wall braces are each additionally displaceably guided in the longitudinal direction on guides in the lower edge of the recess, and wherein the wall braces each have a fixed pivot point at the upper end.

17. The stackable container according to claim 15, wherein each wall brace is additionally guided at the upper end in the longitudinal direction of the wall rail in displaceable fashion on the wall rail.

18. The stackable container according to claim 15, wherein the wall braces are configured to be capable of telescoping, having in each case at least two brace sections that are displaceable relative to one another in a longitudinal direction thereof.

19. The stackable container according to claim 15, wherein two wall rail latches are situated on or in the wall rail that are displaceable between a locking position that locks the wall rail at its two ends, at least in the raised position, to the at least one of the longer and shorter walls having the recess, and an unlocking position.

* * * * *